US011648658B2

(12) United States Patent
Liu

(10) Patent No.: US 11,648,658 B2
(45) Date of Patent: May 16, 2023

(54) SCREWDRIVER STRUCTURE

(71) Applicant: Ningbo King Mount Co., Ltd., Ningbo (CN)

(72) Inventor: Kuan-Ting Liu, Taichung (TW)

(73) Assignee: Ningbo King Mount Co., Ltd., Ningbo (CN)

( * ) Notice: Subject to any disclaimer, the term of this patent is extended or adjusted under 35 U.S.C. 154(b) by 136 days.

(21) Appl. No.: 17/209,497

(22) Filed: Mar. 23, 2021

(65) Prior Publication Data

US 2022/0305636 A1 Sep. 29, 2022

(51) Int. Cl.

| | |
|---|---|
| ***B25G 1/08*** | (2006.01) |
| ***B25B 23/00*** | (2006.01) |
| ***B25B 23/16*** | (2006.01) |

(52) U.S. Cl.
CPC ..... *B25G 1/085* (2013.01); *B25B 23/0035* (2013.01); *B25B 23/16* (2013.01)

(58) Field of Classification Search
CPC ..... B25G 1/085; B25B 23/0035; B25B 23/16
USPC ..... 81/177.4, 438, 439, 490
See application file for complete search history.

(56) References Cited

U.S. PATENT DOCUMENTS 7,258,046 B2 * 8/2007 Fruhm ..... B25G 1/085 81/177.4
10,525,583 B2 * 1/2020 Gorman ..... B25B 23/16

FOREIGN PATENT DOCUMENTS

EP 2698231 A2 2/2014

* cited by examiner

*Primary Examiner* — Don M Anderson
*Assistant Examiner* — Jason Khalil Hawkins
(74) *Attorney, Agent, or Firm* — Alan D. Kamrath; Karin L. Williams; Mayer & Williams PC

(57) ABSTRACT

A screwdriver structure includes a main body, a switch set assembled with the main body, and a press set assembled with the main body and the switch set. The main body is provided with a drive portion, a first chamber, a second chamber, a resting edge, and at least one first slide. The switch set includes two first clamping portions. When the switch set is pressed, the two first clamping portions are moved toward each other or moved away from each other. The press set is pressed and moved in the first chamber to push the switch set, so that the two first clamping portions are moved to clamp and lock the press set. When the press set is pressed again, the two first clamping portions are moved to release the press set.

10 Claims, 14 Drawing Sheets

C-C

D-D

SCREWDRIVER STRUCTURE

BACKGROUND OF THE INVENTION

1. Field of the Invention

The present invention relates to a hand tool and, more particularly, to a screwdriver structure.

2. Description of the Related Art

A conventional screwdriver structure was disclosed in the European Patent No. 2 698 231 or Taiwanese Patent Publication No. 1532570, and comprises a handle, and a cover 18.

However, the conventional screwdriver structure has the following disadvantages.

1. The cover 18 is provided with a slide valve 28. When the user wishes to remove the cover 18 from the handle, the slide valve 28 is moved to compress the compression spring 42 so as to detach the stop hook 30 from the stop flange 26 so that the cover 18 is unlocked and can be released from the handle. Thus, the slide valve 28 is moved to lock or unlock the cover 18. However, the user has to move the slide valve 28 to open or fold the cover 18, thereby causing inconvenience to the user and wasting the time and manual labor.

2. The handle and the cover 18 have a smaller volume, thereby limiting the operation space of the slide valve 28, and thereby limiting the contact area of the slide valve 28 with the user's hand.

3. The stop hook 30 and the stop flange 26 have to withstand the elastic force of the compression spring 42. However, the stop hook 30 and the stop flange 26 are locked by a single side so that the stop hook 30 cannot withstand a large force.

4. The user has to hold the handle by one hand and to move the slide valve 28 by the other hand. However, the slide valve 28 has a smaller volume and has a limited operation space, so that the user cannot clearly see the right position of the slide valve 28, thereby failing the operation.

BRIEF SUMMARY OF THE INVENTION

In accordance with the present invention, there is provided a screwdriver structure comprising a main body, a switch set assembled with the main body, and a press set assembled with the main body and the switch set. The main body is provided with a drive portion, a first chamber, a second chamber, a resting edge, and at least one first slide. The switch set includes two first clamping portions. When the switch set is pressed, the two first clamping portions are moved toward each other or moved away from each other. The press set is pressed and moved in the first chamber to push the switch set, so that the two first clamping portions are moved to clamp and lock the press set. When the press set is pressed again, the two first clamping portions are moved to release the press set.

According to the primary advantage of the present invention, the press set is assembled with the main body and the switch set and is movable in the first chamber. When the press set is pressed, the press set is moved to push the switch set so that the press set is locked by the two first clamping portions and positioned in the first chamber without detachment. When the press set is pressed again, the press set is unlocked from the two first clamping portions so that the press set is moved and exposed from the main body. Thus, the user only needs to press the press set reciprocatingly to fold the press set onto the main body or expose the press set from the main body, thereby facilitating the user operating the screwdriver structure.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
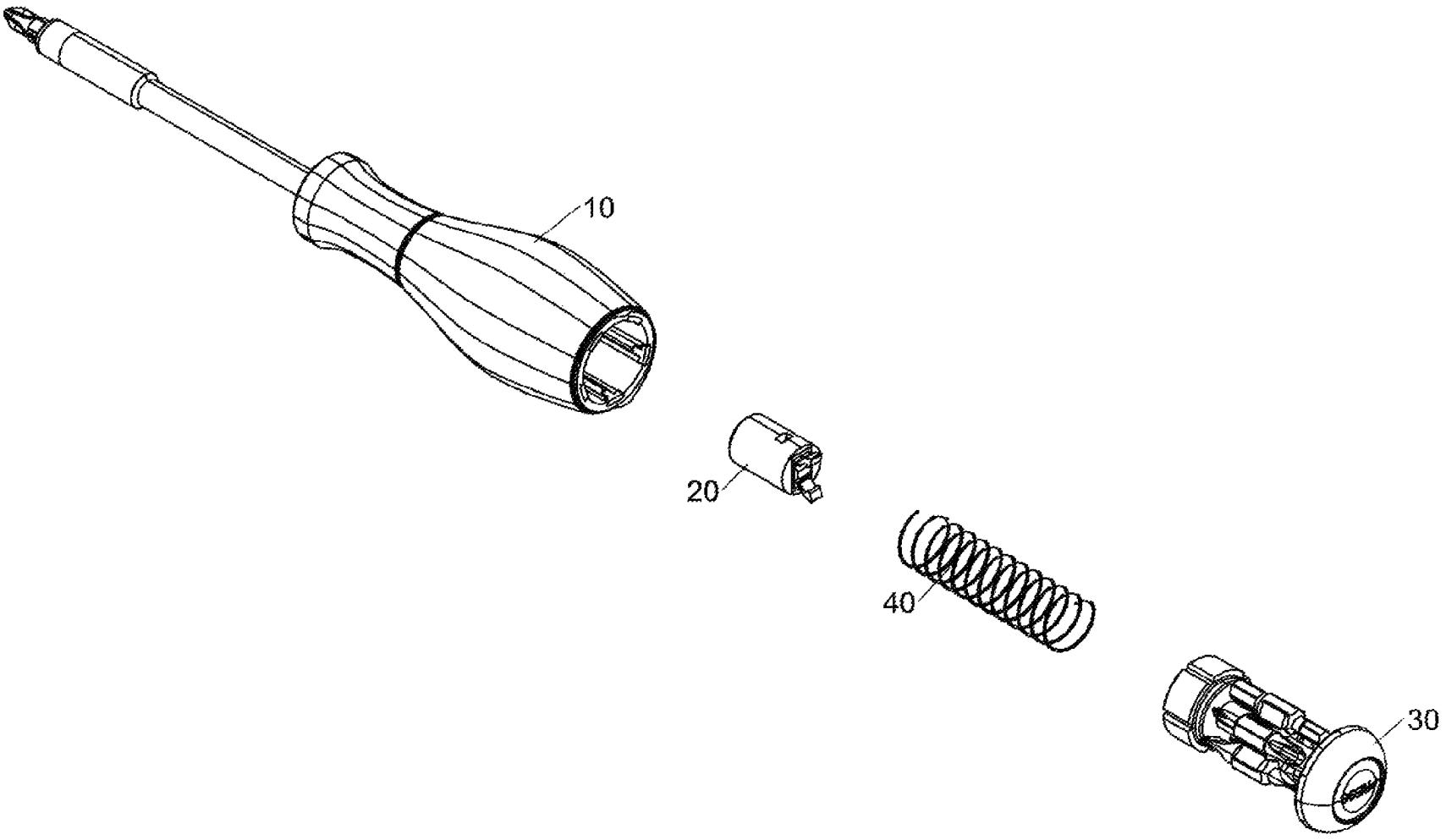
FIG. 1 is a partial exploded perspective view of a screwdriver structure in accordance with the preferred embodiment of the present invention.
Figure 2:
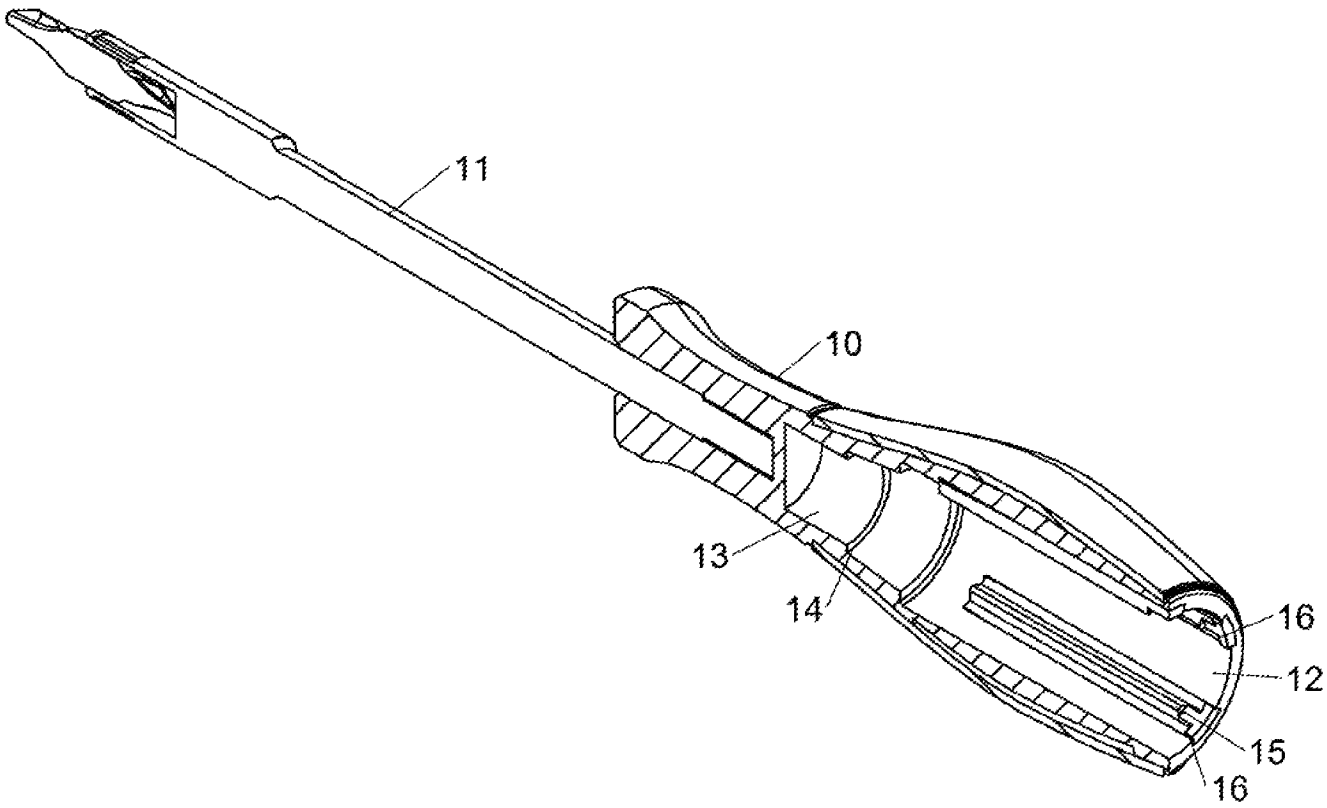
FIG. 2 is a perspective cross-sectional view of a main body of the screwdriver structure in accordance with the preferred embodiment of the present invention.
Figure 3:
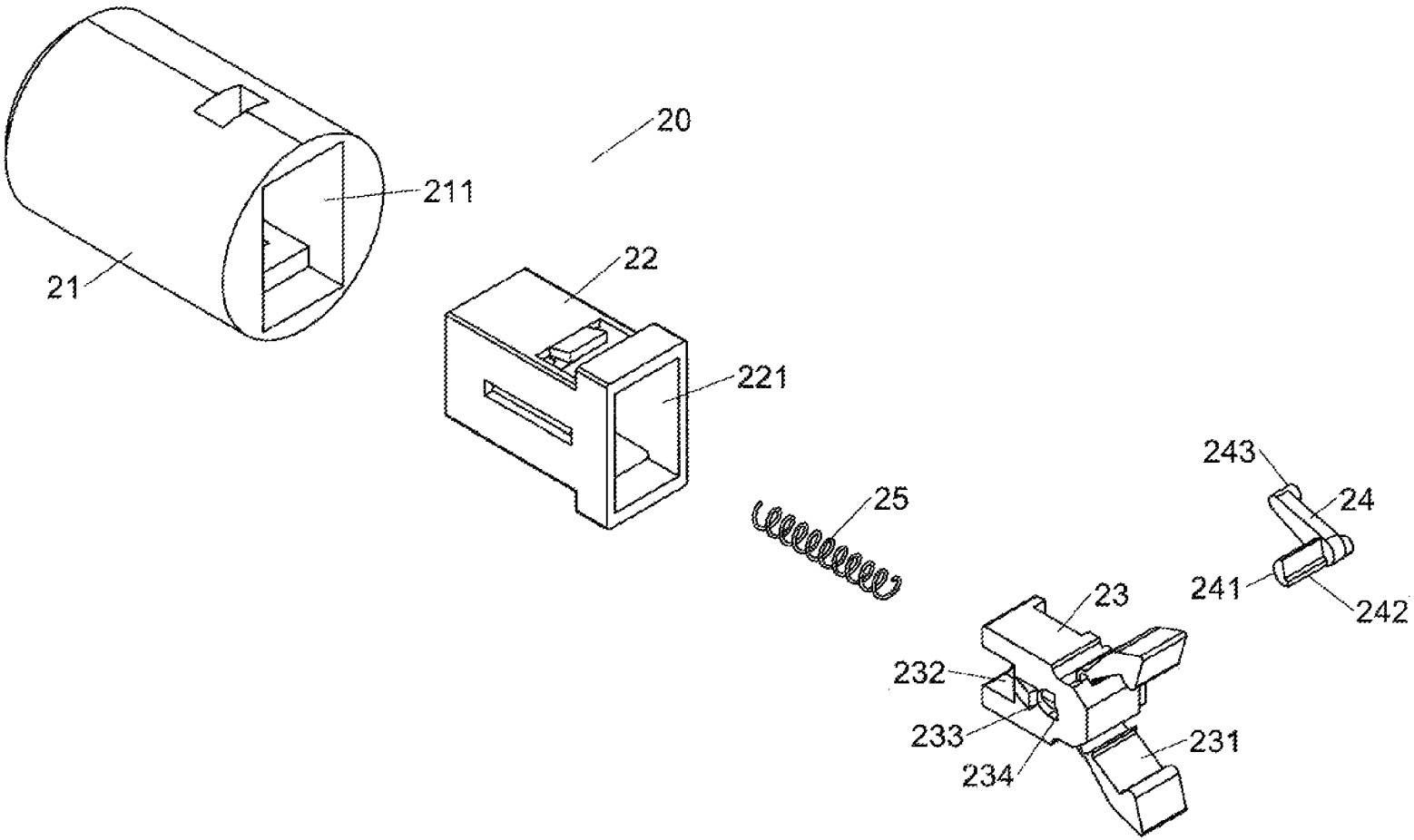
FIG. 3 is an exploded perspective view of a switch set of the screwdriver structure in accordance with the preferred embodiment of the present invention.
Figure 5:
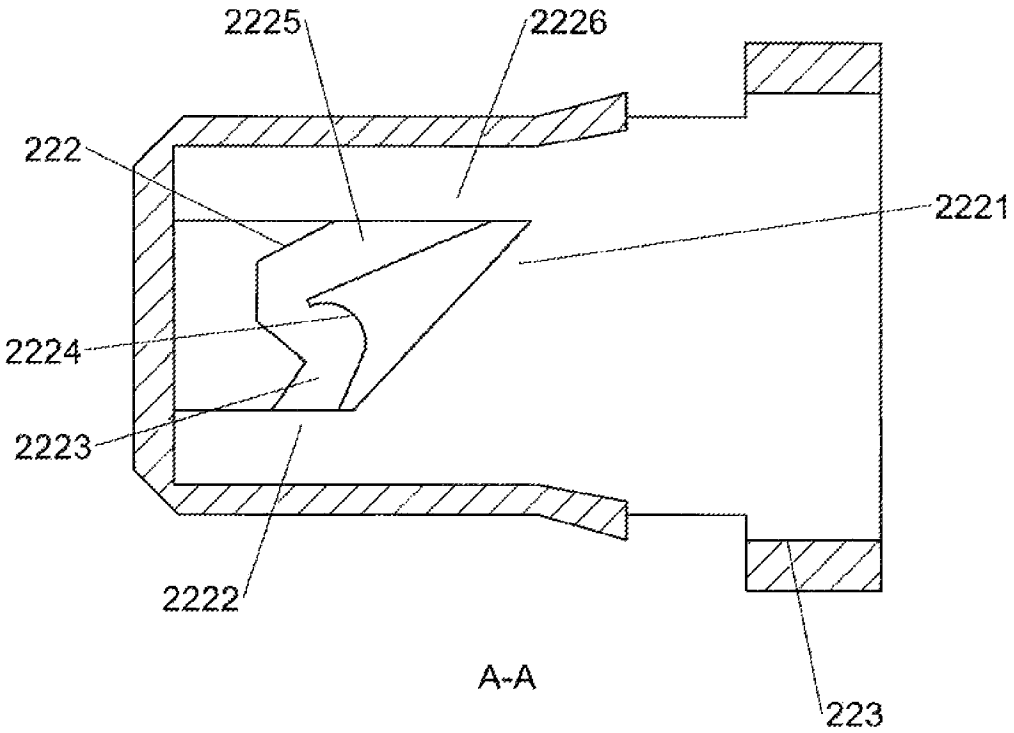
FIG. 5 is a cross-sectional view of the second seat of the screwdriver structure taken along line A-A as shown in FIG. 4.
Figure 4:
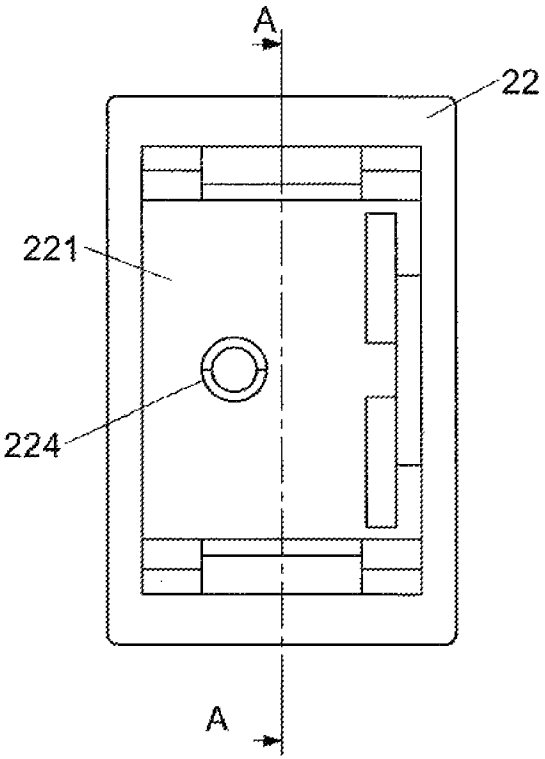
FIG. 4 is a side view of a second seat of the screwdriver structure in accordance with the preferred embodiment of the present invention.

Referring to the drawings and initially to FIGS. 1-14, a screwdriver structure in accordance with the preferred embodiment of the present invention comprises a main body 10, a switch (or locking) set 20 assembled with the main body 10, and a press (or push) set 30 assembled with the main body 10 and the switch set 20.

The main body 10 has a first end provided with a drive portion 11 and a second end provided with a handle (or grip). The handle has an interior provided with a first chamber 12 and a second chamber 13. The first chamber 12 is distant from the drive portion 11 and has an opening extending to an end portion of the handle. The second chamber 13 is connected to the first chamber 12 and arranged between the drive portion 11 and the first chamber 12. The second chamber 13 has a diameter less than that of the first chamber 12, and a resting edge 14 is formed between the first chamber 12 and the second chamber 13. The main body 10 is provided with at least one first slide 15. The at least one first slide 15 has an end portion provided with a first limit portion 16 close to the opening of the first chamber 12.

The switch set 20 is mounted in the first chamber 12 and the second chamber 13. The switch set 20 includes a first seat 21 secured in the second chamber 13, a second seat 22 secured in the first receiving recess 211, a clamping block 23 mounted in the second receiving recess 221, a control member 24 assembled with the second seat 22 and the clamping block 23, and a first elastic member 25 elastically biased between the second seat 22 and the clamping block 23 to provide a restoring effect to the clamping block 23.

The first seat 21 has an interior provided with a first receiving recess 211.

The second seat 22 has an interior provided with a second receiving recess 221 and has a side provided with a slideway 222 connected to the second receiving recess 221. The slideway 222 includes a first path 2221, a second path 2222, a third path 2223, a locking portion 2224, a fourth path 2225, and a fifth path 2226. The first path 2221, the second path 2222, the third path 2223, the locking portion 2224, the fourth path 2225, and the fifth path 2226 construct a loop or circuit or closed route. The second seat 22 is provided with two first abutting portions 223 close to an opening of the second receiving recess 221. The second receiving recess 221 has a bottom provided with a first shaft 224 (see FIG. 4).

The clamping block 23 has a first end provided with two first clamping portions 231 and a second end provided with a first receiving slot 232. The two first clamping portions 231 align with each other. The clamping block 23 is movable in the second receiving recess 221 between a first location where the two first clamping portions 231 are pressed by the two first abutting portions 223 and approach each other, and a second location where the two first clamping portions 231 are released from the two first abutting portions 223, are spaced from each other, and are exposed from the second receiving recess 221. The first receiving slot 232 aligns with the first shaft 224 and has an opening distant from the two first clamping portions 231. The clamping block 23 is provided with a third receiving recess 233 penetrating the clamping block 23. The third receiving recess 233 is connected to the first receiving slot 232 and is arranged between the two first clamping portions 231 and the first receiving slot 232. The third receiving recess 233 is provided with a second abutting portion 234.

In practice, when the switch set 20 is pressed, the two first clamping portions 231 are moved toward each other, and when the switch set 20 is pressed again, the two first clamping portions 231 are moved away from each other. That is, when the switch set 20 is pressed, the two first clamping portions 231 are moved toward each other or moved away from each other.

The control member 24 is provided with a second shaft 241 extending through the third receiving recess 233. The second shaft 241 is provided with a third abutting portion 242. The second shaft 241 is movable between a first location where the third abutting portion 242 rests on the second abutting portion 234 and a second location where the third abutting portion 242 is detached from the second abutting portion 234. The control member 24 is provided with a moving portion 243 received in the slideway 222.

When the clamping block 23 is pressed and moved in the second receiving recess 221, the moving portion 243 is moved in the slideway 222, so that the second shaft 241 is driven by the clamping block 23 and rotated in the third receiving recess 233. The clamping block 23 is movable relative to the second seat 22 between a first (or unlocked) position where the moving portion 243 is located at the first path 2221 and a second (or locked) position where the moving portion 243 is locked on the locking portion 2224.

In such a manner, when the second shaft 241 is driven by the clamping block 23 and rotated in the third receiving recess 233, the moving portion 243 is moved in the slideway 222, unlocked from the locking portion 2224, and located at the first path 2221, such that the clamping block 23 is situated at the first position where the third abutting portion 242 rests on the second abutting portion 234.

Alternatively, when the second shaft 241 is further driven by the clamping block 23 and rotated in the third receiving recess 233, the moving portion 243 is moved in the slideway 222 and locked in the locking portion 2224, such that the clamping block 23 is situated at the second position where the third abutting portion 242 is detached from the second abutting portion 234.

Figure 6:
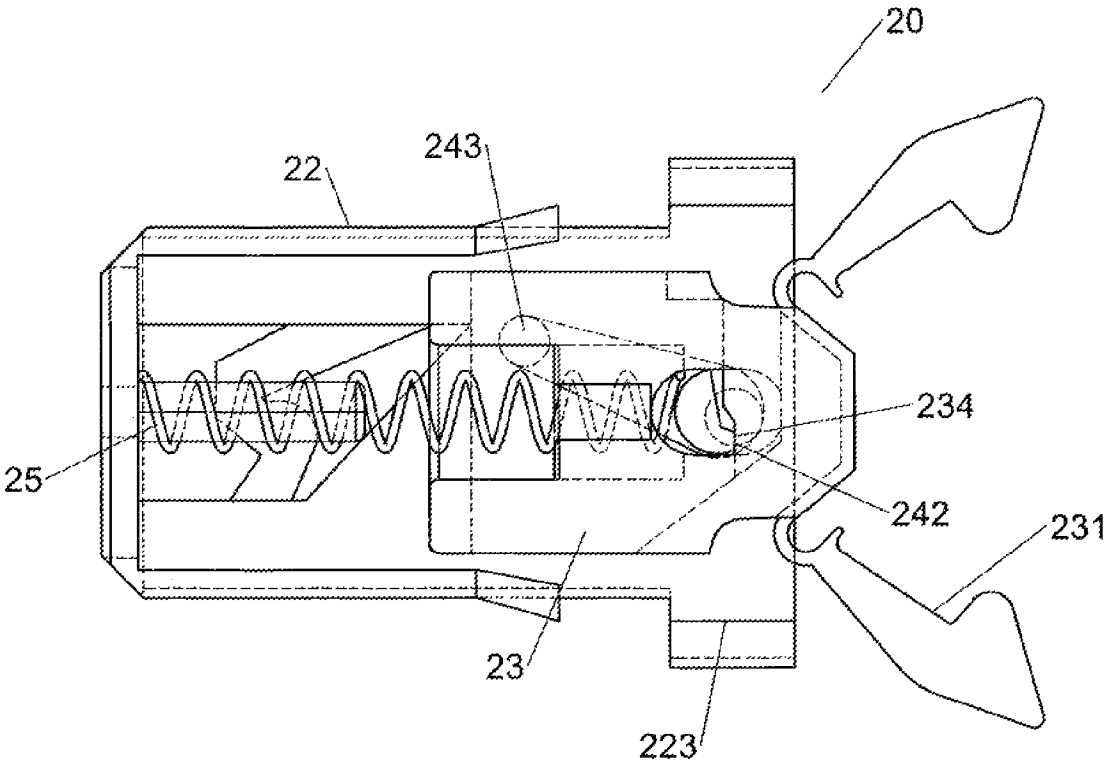
FIG. 6 is a front view showing a first operation state of the switch set of the screwdriver structure in accordance with the preferred embodiment of the present invention.
Figure 8:
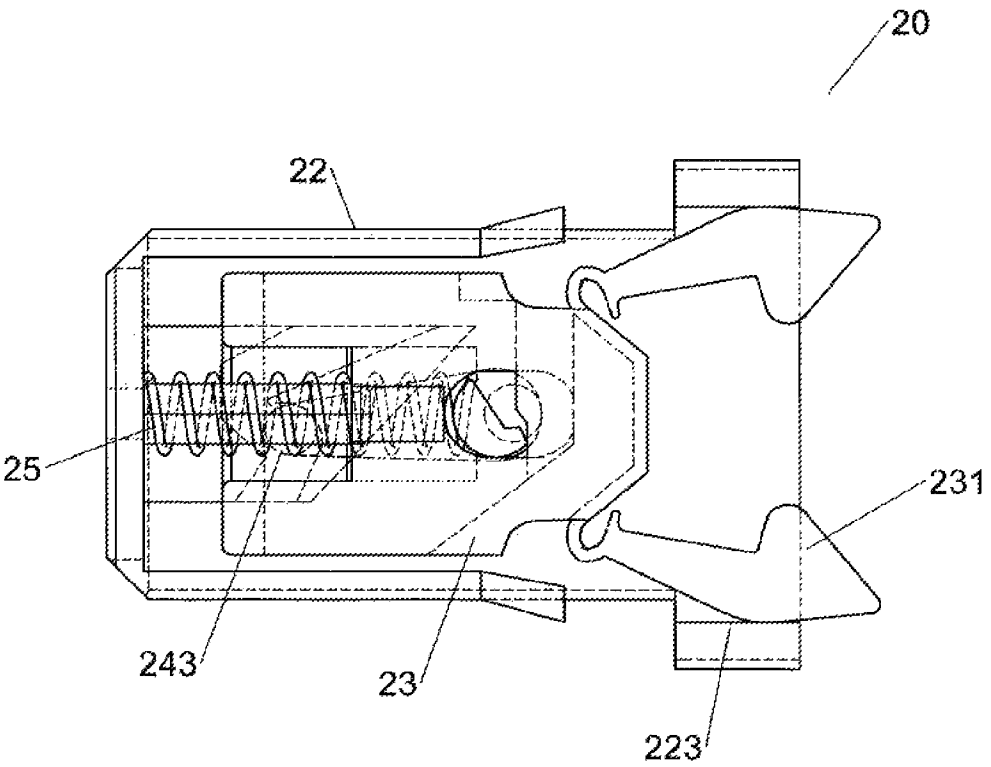
FIG. 8 is a front view showing a third operation state of the switch set of the screwdriver structure in accordance with the preferred embodiment of the present invention.
Figure 10:
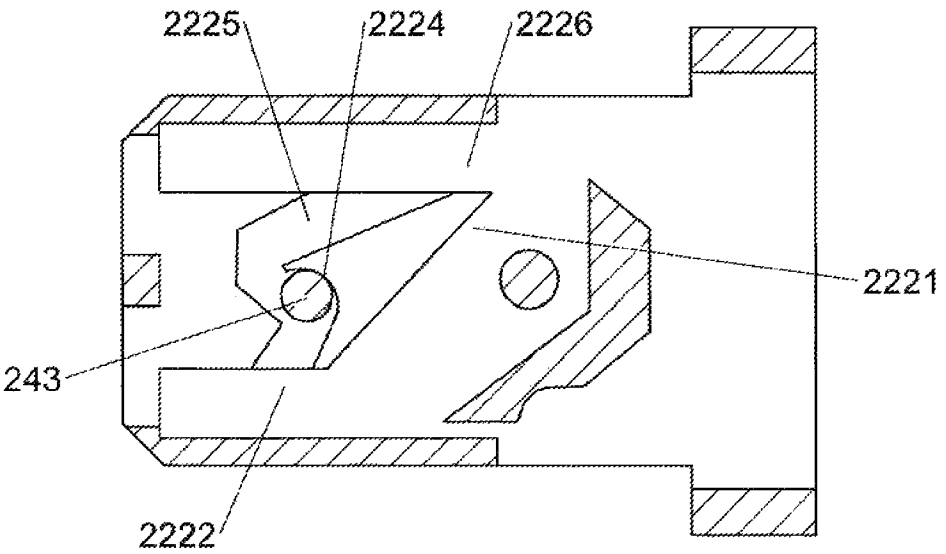
FIG. 10 is a cross-sectional view of the switch set of the screwdriver structure taken along line C-C as shown in FIG. 9.
Figure 9:
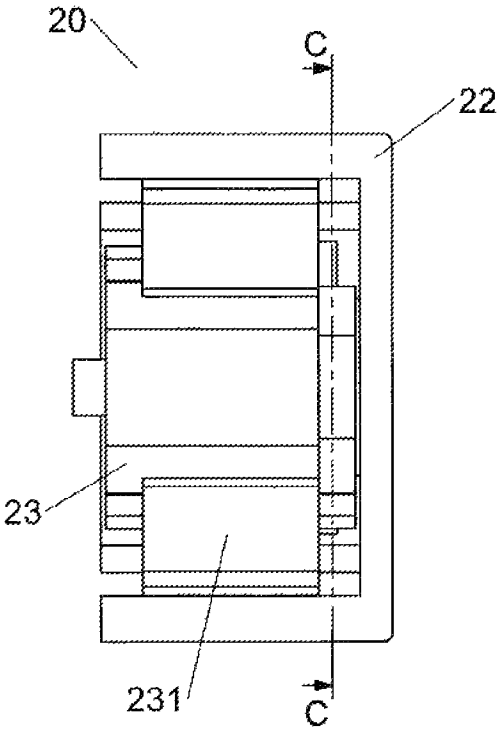
FIG. 9 is a side view showing the third operation state of the switch set of the screwdriver structure in accordance with the preferred embodiment of the present invention.
Figure 12:
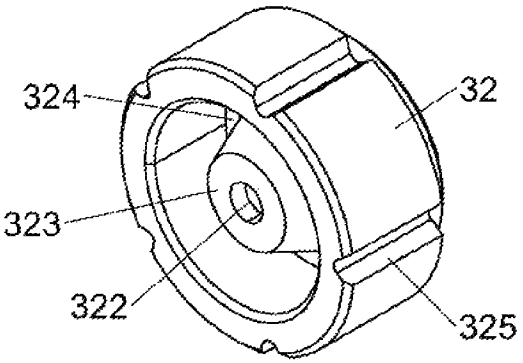
FIG. 12 is a perspective cross-sectional view of a third seat of the screwdriver structure in accordance with the preferred embodiment of the present invention.
Figure 11:
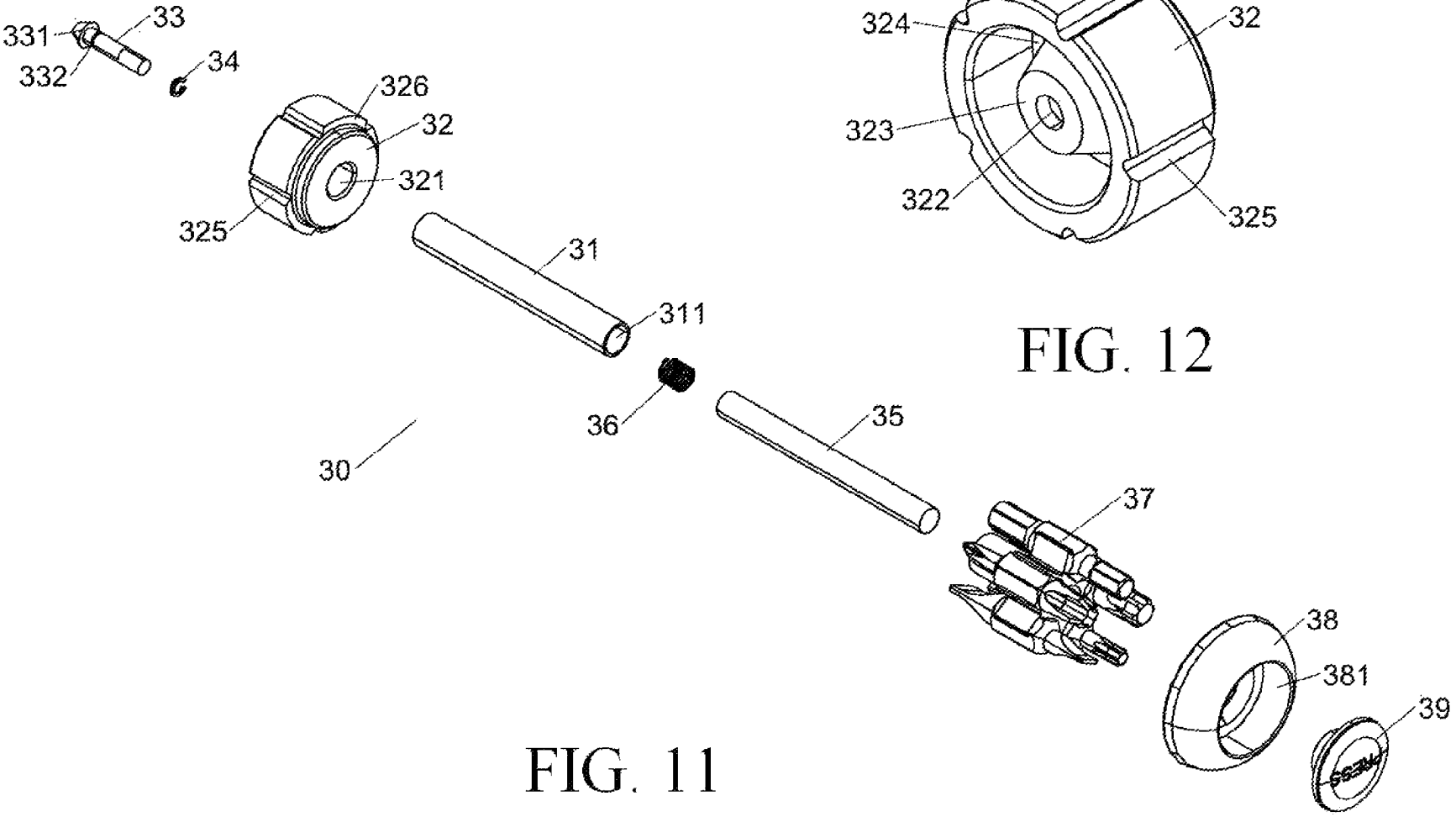
FIG. 11 is an exploded perspective view of a press set of the screwdriver structure in accordance with the preferred embodiment of the present invention.
Figure 14:
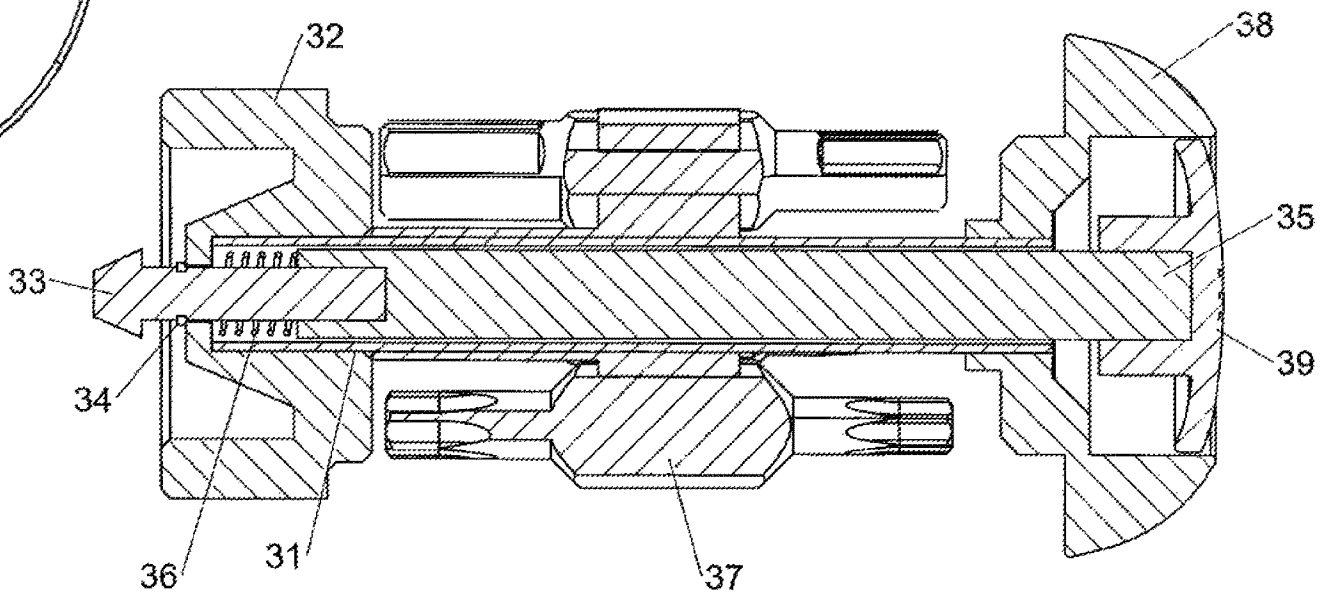
FIG. 14 is a cross-sectional view of the press set of the screwdriver structure taken along line D-D as shown in FIG. 13.
Figure 13:
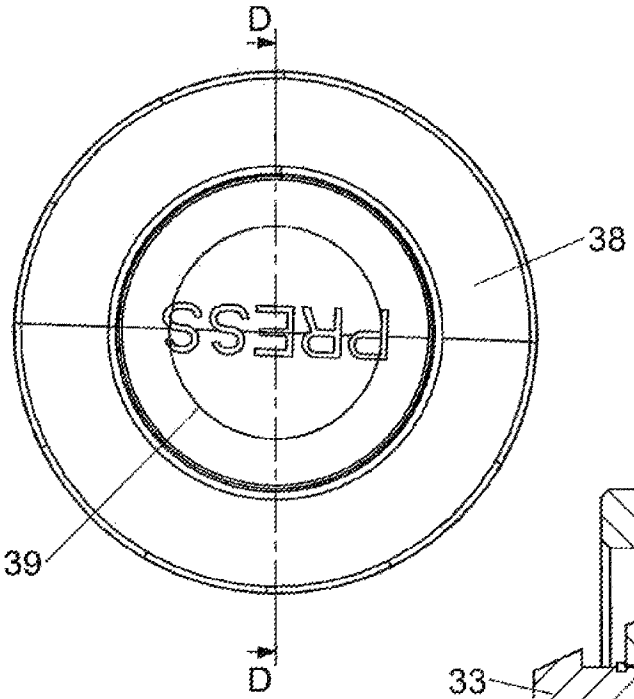
FIG. 13 is a side view of the press set of the screwdriver structure in accordance with the preferred embodiment of the present invention.

Thus, when the clamping block 23 is pressed repeatedly, the clamping block 23 is movable between the first position and the second position reciprocatingly. At this time, the two first clamping portions 231 are away from each other when the clamping block 23 is at the first position as shown in FIG. 6 and are moved toward each other when the clamping block 23 is at the second position as shown in FIG. 8.

The first elastic member 25 is disposed between the second receiving recess 221 and the first receiving slot 232. The first elastic member 25 is mounted on the first shaft 224 and is biased between a bottom of the second receiving recess 221 and the second shaft 241.

In practice, the first elastic member 25 is biased between the second seat 22 and the clamping block 23, such that the two first clamping portions 231 are spaced from each other and exposed from the second receiving recess 221. The third abutting portion 242 rests on the second abutting portion 234 by an elastic force of the first elastic member 25, such that the moving portion 243 is located at the first path 2221, and the clamping block 23 is situated at the first position relative to the second seat 22 as shown in FIG. 6.

Figure 7:
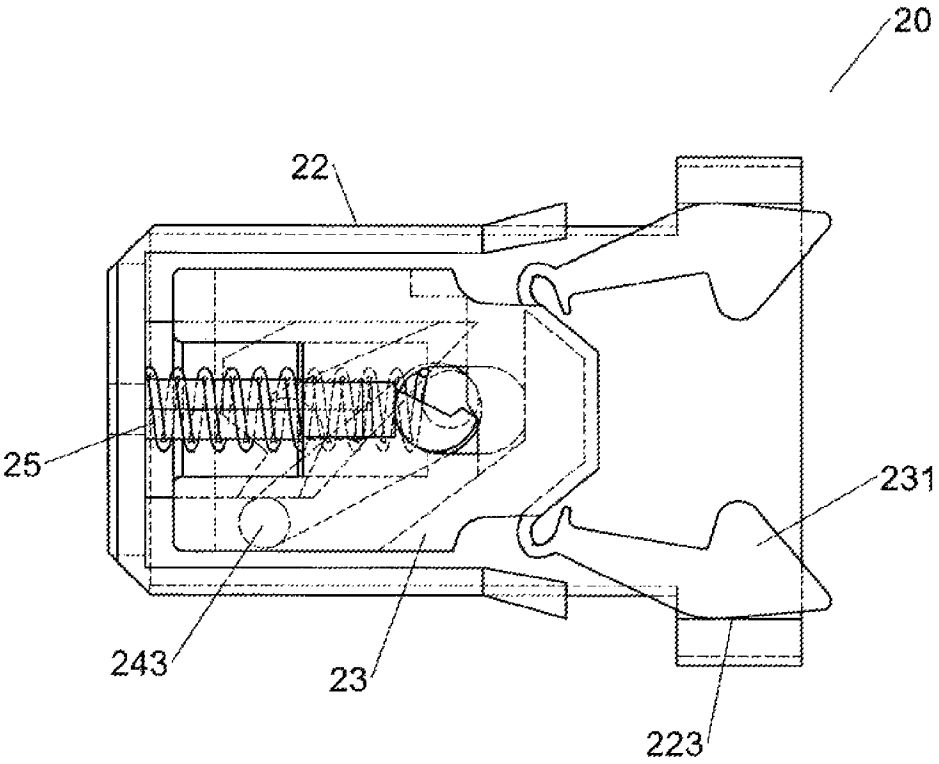
FIG. 7 is a front view showing a second operation state of the switch set of the screwdriver structure in accordance with the preferred embodiment of the present invention.

When the clamping block 23 is pressed and moved in the second receiving recess 221, the two first clamping portions 231 are pressed by the two first abutting portions 223 such that the two first clamping portions 231 are moved toward each other and retracted in the second receiving recess 221 as shown in FIG. 7. When the control member 24 is driven and moved by the clamping block 23, the second shaft 241 is rotated in the third receiving recess 233, and the third abutting portion 242 is detached from the second abutting portion 234, so that the moving portion 243 is serially moved along the first path 2221 and the second path 2222, and the first elastic member 25 is compressed by the control member 24 and the clamping block 23.

When the moving portion 243 is further moved along the third path 2223 to the locking portion 2224, the moving portion 243 is locked on the locking portion 2224, the switch set 20 is disposed at a locked state, the first elastic member 25 is slightly returned, and the control member 24 and the clamping block 23 are pushed slightly by the first elastic member 25 and moved toward the opening of the second receiving recess 221, such that the two first clamping portions 231 are moved to partially protrude from the second receiving recess 221 and are moved toward each other, and the clamping block 23 is situated at the second position relative to the second seat 22 as shown in FIG. 8.

When the clamping block 23 is pressed again, the moving portion 243 is unlocked from the locking portion 2224, and the clamping block 23 is pushed by the first elastic member 25, such that the moving portion 243 is serially moved along the fourth path 2225 and the fifth path 2226 to the first path 2221, and the clamping block 23 is returned to the first position as shown in FIG. 6.

The press set 30 is pressed and moved in the first chamber 12 to push the switch set 20, so that the two first clamping portions 231 are moved to clamp the press set 30, and the press set 30 is positioned in and cannot be removed from the first chamber 12. When the press set 30 is pressed again, the two first clamping portions 231 are moved to release the press set 30, such that the press set 30 is movable toward the opening of the first chamber 12.

The press set 30 includes a tube 31, a third seat 32, a pin 33, a snap ring 34, a rod (or pole) 35, a second elastic member 36, a tip set 37, a cover 38, and a push (or press) member 39.

The tube 31 is provided with a passage 311 penetrating the tube 31.

The third seat 32 is movably mounted in the first chamber 12. The third seat 32 is fitted with the tube 31 so that the tube 31 and the third seat 32 are moved simultaneously. Thus, when the third seat 32 is moved in the first chamber 12, the tube 31 is moved with the third seat 32 so that the tube 31 is hidden in the first chamber 12 or protrudes from the main body 10. The third seat 32 has a first end provided with a coupling (or connecting or combining) portion 321 fitted on the tube 31 so that the tube 31 and the third seat 32 are combined. The coupling portion 321 is located at a center of the third seat 32 and has an opening aligning with the opening of the first chamber 12. The coupling portion 321 has a bottom provided with a first resting face 322 abutting the tube 31. The third seat 32 has a second end provided with a second resting face 323 and a second receiving slot 324. The second resting face 323 aligns with the two first clamping portions 231 and is arranged in the second receiving slot 324. The second receiving slot 324 has an opening facing the second chamber 13. The third seat 32 has an exterior provided with at least one second slide 325 slidably connected with the at least one first slide 15 so that the third seat 32 is slidable linearly in the first chamber 12. The at least one second slide 325 is provided with a second limit portion 326 that is movable to abut the first limit portion 16 so that the second limit portion 326 is restricted by the first limit portion 16, to prevent the third seat 32 from being detached from the first chamber 12.

The pin 33 passes the passage 311 and the coupling portion 321. The pin 33 has a first end provided with a second clamping portion 331 protruding from the third seat 32. The second clamping portion 331 aligns with the switch set 20 and presses the clamping block 23. The second clamping portion 331 engages the two first clamping portions 231. When the clamping block 23 is situated at the second position, the second clamping portion 331 is clamped with the two first clamping portions 231 so that the switch set 20 is disposed at the locked state. The pin 33 is provided with a retaining groove 332 protruding from the coupling portion 321.

The snap ring 34 is retained in the retaining groove 332.

The rod 35 is movably mounted in the passage 311. The rod 35 has a recessed first end fitted with a second end of the pin 33 and a second end protruding from the tube 31. The rod 35 drives and moves the pin 33 when the rod 35 is moved relative to the tube 31.

The second elastic member 36 is received in the passage 311 and mounted on the pin 33. The second elastic member 36 is elastically biased between the first resting face 322 and the first end of the rod 35.

The tip set 37 is mounted on the tube 31. The tip set 37 is moved with the tube 31 synchronously so that the tip set 37 is hidden in the first chamber 12 or protrudes from the main body 10.

The cover 38 is fitted with the tube 31 and covers the opening of the first chamber 12 so that the first chamber 12 is disposed at a closed state. The cover 38 is spaced from the third seat 32 and provided with a receiving space 381 allowing passage of the rod 35.

The push member 39 is fitted on the second end of the rod 35 and housed in the receiving space 381. The push member 39 is movable in the receiving space 381 through a determined distance. When the push member 39 is pushed or pressed, the rod 35 and the pin 33 are driven by the push member 39 and moved in the passage 311, and the second elastic member 36 is compressed by the rod 35.

When the third seat 32 is moved in the first chamber 12, the at least one second slide 325 slides relative to the at least one first slide 15, such that the tube 31, the pin 33, the snap ring 34, the rod 35, the second elastic member 36, the tip set 37, the cover 38, and the push member 39 are moved synchronously.

In assembly, referring to FIGS. 11-14 reference to FIGS. 1-10, the third seat 32 is secured on the tube 31, and the at least one second slide 325 is slidably connected with the at least one first slide 15 so that the at least one second slide 325 is slidable on the at least one first slide 15. The second clamping portion 331 protrudes from the third seat 32 and aligns with the two first clamping portions 231. The snap ring 34 is mounted in the retaining groove 332 and rests on the second resting face 323. The second end of the pin 33 is fitted into the first end of the rod 35. The second elastic member 36 is received in the passage 311. The tip set 37 is mounted on the tube 31. The cover 38 is secured on the tube 31 so that the cover 38 and the tube 31 are moved synchronously. The receiving space 381 allowing passage of the rod 35. The push member 39 is fitted on the second end of the rod 35 and housed in the receiving space 381. The push member 39 is movable in the receiving space 381 through a determined distance. When the push member 39 is pressed, the rod 35 and the pin 33 are driven by the push member 39 and moved in the passage 311.

The screwdriver structure further comprises a third elastic member 40 housed in the first chamber 12 and elastically biased between the resting edge 14 and the press set 30. When the press set 30 protrudes from the main body 10, the third elastic member 40 is elastically biased between the resting edge 14 and the press set 30 so that the press set 30 is distant from the main body 10 and the switch set 20.

In the preferred embodiment of the present invention, the drive portion 11 has a recessed end receiving various tips or has a square head. The main body 10 has multiple first slides 15 which are arranged annularly in an inner face of the first chamber 12. The third seat 32 has multiple second slides 325 which are arranged annularly.

In the preferred embodiment of the present invention, the at least one first slide 15 is mounted on or integrally formed on the main body 10.

In the preferred embodiment of the present invention, the first seat 21 has a circular hollow shape. The first receiving recess 211 has a rectangular shape. The opening of the second receiving recess 221 and the opening of the first receiving recess 211 are parallel with each other. The second receiving recess 221 has a rectangular shape. The locking portion 2224 has an arcuate concave shape. The first shaft 224 has a cylindrical shape. The moving portion 243 is a circular stub.

In the preferred embodiment of the present invention, the passage 311 has a circular shape. The coupling portion 321 is a circular recess. The second receiving slot 324 has a circular shape. The at least one second slide 325 has a number matching that of the at least one first slide 15. The retaining groove 332 has an annular shape and aligns with the second resting face 323. The snap ring 34 rests on the second resting face 323. The rod 35 has a circular shape. The tip set 37 includes multiple screwdriver tips of different specifications. The screwdriver tips are interchangeably mounted on the drive portion 11.

In the preferred embodiment of the present invention, the third elastic member 40 is a spring that is elastically biased between the resting edge 14 and the second receiving slot 324.

In the preferred embodiment of the present invention, each of the two first clamping portions 231 is made of flexible material. Thus, when the two first clamping portions 231 are pressed by the two first abutting portions 223, the two first clamping portions 231 are flexed to store a restoring force, and when the two first clamping portions 231 are detached from the two first abutting portions 223, the two first clamping portions 231 are extended outward by the restoring force.

In operation, when the cover 38 is pushed, the cover 38, the tube 31, and the third seat 32 are moved synchronously, and the at least one second slide 325 slides on the at least one first slide 15, such that the cover 38 drives and moves the press set 30. When the press set 30 is moved in the first chamber 12 toward the switch set 20, the third seat 32 compresses the third elastic member 40, the pin 33 pushes the clamping block 23, and the two first clamping portions 231 are pressed by the two first abutting portions 223 such that the two first clamping portions 231 are moved toward each other and retracted in the second receiving recess 221. At this time, the clamping block 23 moves the control member 24 and presses the first elastic member 25, the second shaft 241 is rotated in the third receiving recess 233, the moving portion 243 is serially moved along the first path 2221, the second path 2222, and the third path 2223 to the locking portion 2224, and is locked on the locking portion 2224, such that the switch set 20 is disposed at the locked state, and the clamping block 23 is situated at the second position as shown in FIGS. 7 and 8.

After the moving portion 243 is locked on the locking portion 2224, the first elastic member 25 is slightly returned, the control member 24 and the clamping block 23 are pushed slightly by the first elastic member 25 and moved toward the opening of the second receiving recess 221, such that the two first clamping portions 231 are moved to partially protrude from the second receiving recess 221, and the second clamping portion 331 is clamped by the two first clamping portions 231. In such a manner, the second clamping portion 331 is restricted by the two first clamping portions 231 such that the press set 30 is locked by the switch set 20 and retracted in the main body 10, and the cover 38 covers the first chamber 12.

When the push member 39 is pressed, the rod 35 and the pin 33 are driven by the push member 39 and moved toward the switch set 20, the second elastic member 36 is compressed by the rod 35, the pin 33 pushes the clamping block 23 which moves the control member 24 and presses the first elastic member 25, the second shaft 241 is rotated in the third receiving recess 233, such that the moving portion 243 is unlocked from the locking portion 2224, and the clamping block 23 is pushed by the first elastic member 25, such that the moving portion 243 is serially moved along the fourth path 2225 and the fifth path 2226 to the first path 2221. The first elastic member 25 is elastically returned and moves the control member 24 and the clamping block 23, and the two first clamping portions 231 are detached from the two first abutting portions 223 such that the two first clamping portions 231 are spaced from each other and fully exposed from the second receiving recess 221, the switch set 20 is disposed at the unlocked state, and the clamping block 23 is situated at the first position as shown in FIG. 6. Thus, the second clamping portion 331 is released from the two first clamping portions 231, and the press set 30 is unlocked from the switch set 20, such that the press set 30 is pushed by the third elastic member 40, and the at least one second slide 325 slides on the at least one first slide 15, such that the press set 30 is exposed from the first chamber 12 to facilitate the user taking the tip set 37 as shown in FIG. 15.

Figure 15:
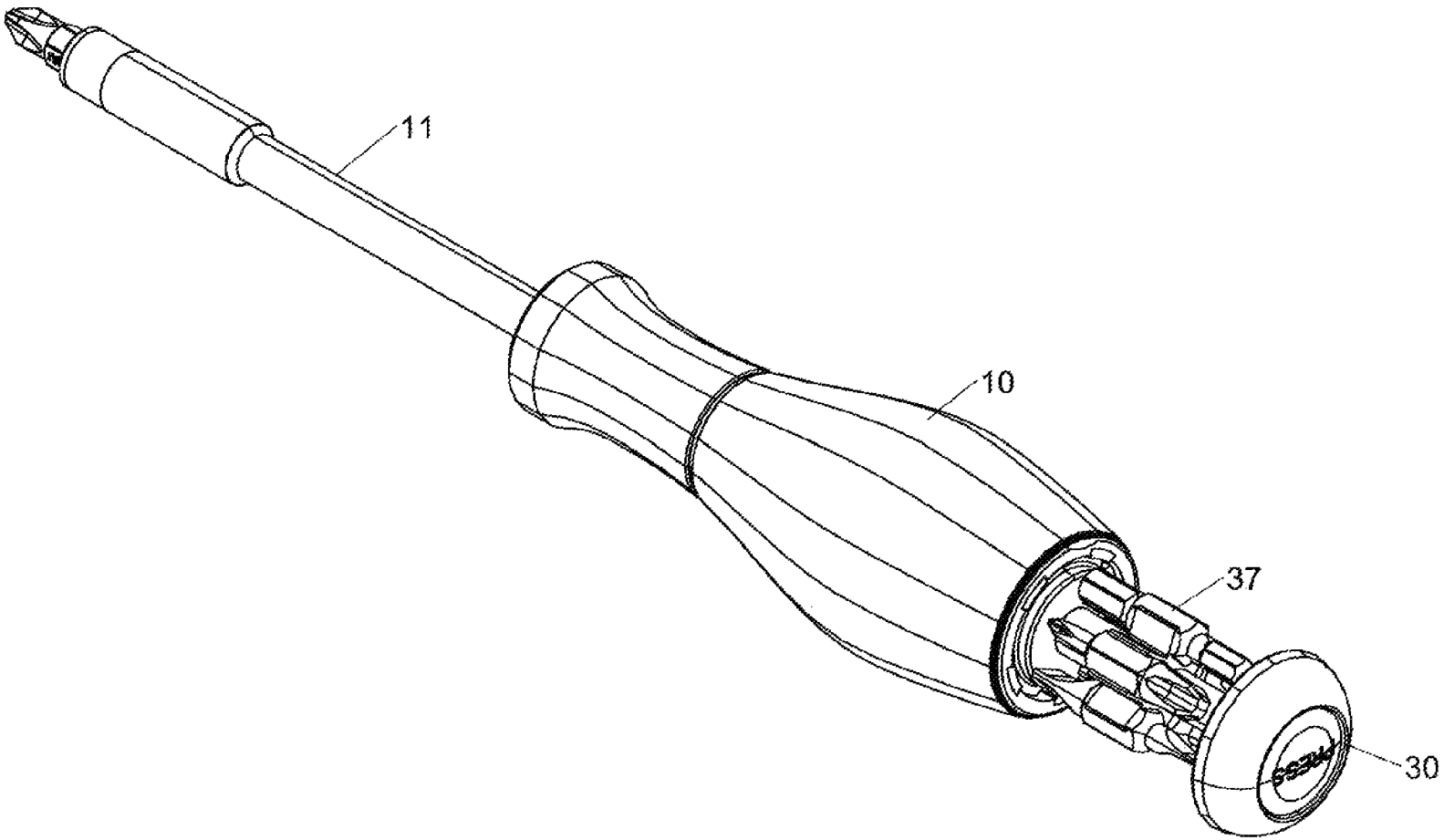
FIG. 15 is a perspective view of the screwdriver structure in accordance with the preferred embodiment of the present invention.
Figure 16:
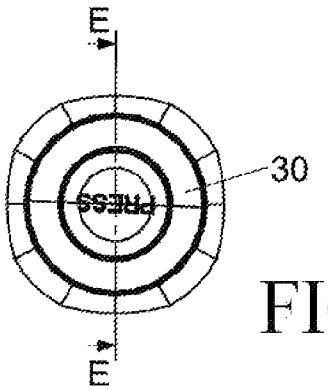
FIG. 16 is a side view of the screwdriver structure as shown in FIG. 15.
Figure 17:
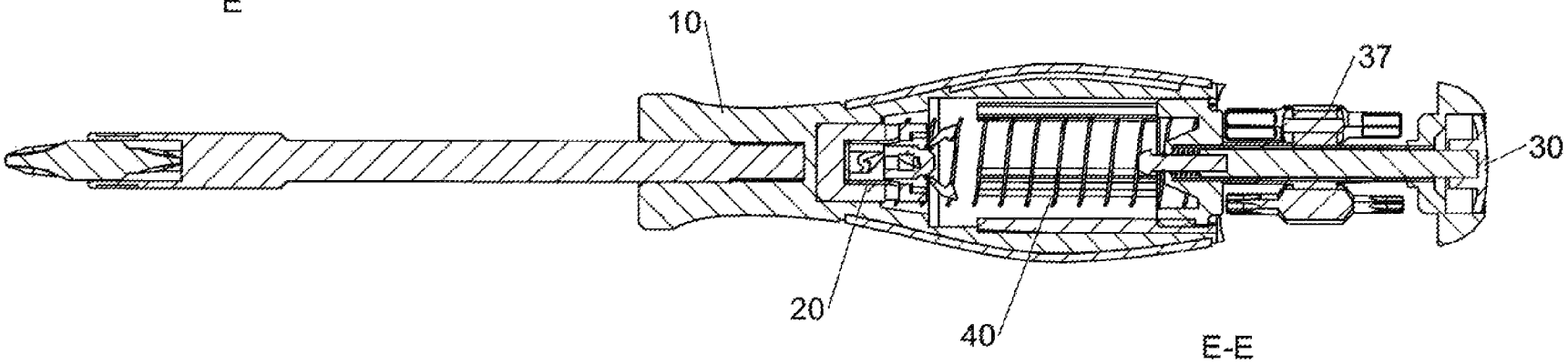
FIG. 17 is a cross-sectional view of the screwdriver structure taken along line E-E as shown in FIG. 16.

Referring to FIGS. 15-17 with reference to FIGS. 1-14, the switch set 20 is secured in the second chamber 13, and the two first clamping portions 231 align with the opening of the first chamber 12. The press set 30 is assembled with the main body 10. The at least one second slide 325 is slidably connected with the at least one first slide 15, and the press set 30 is moved relative to the switch set 20, so that the press set 30 is hidden in the first chamber 12 or protrudes from the main body 10. The third elastic member 40 is elastically biased between the resting edge 14 and the second receiving slot 324. When the press set 30 is exposed from the first chamber 12 of the main body 10, the tip set 37 is exposed completely to facilitate the user taking the screwdriver tips of the tip set 37 for the drive portion 11.

Figure 18:
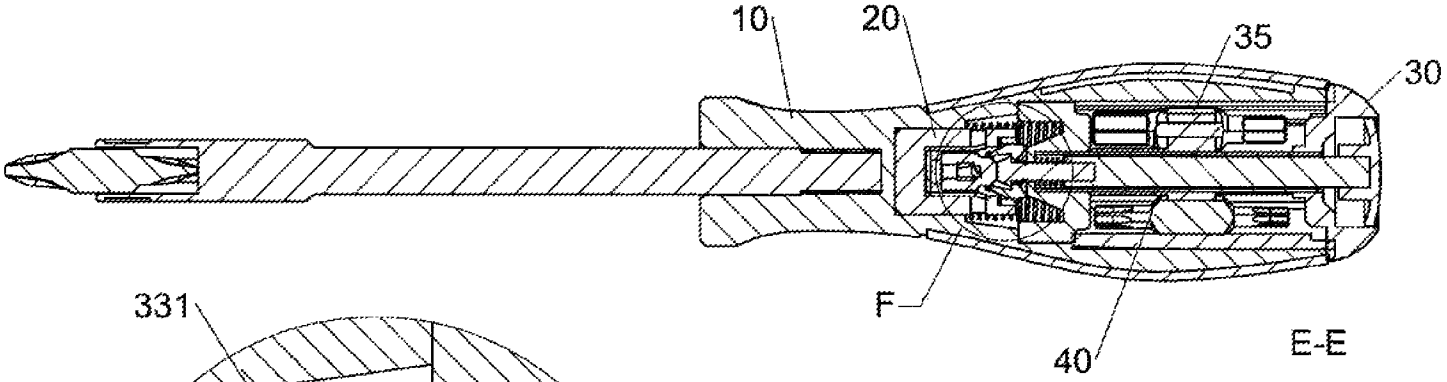
FIG. 18 is a cross-sectional view showing operation of the screwdriver structure taken along line E-E as shown in FIG. 16.
Figure 19:
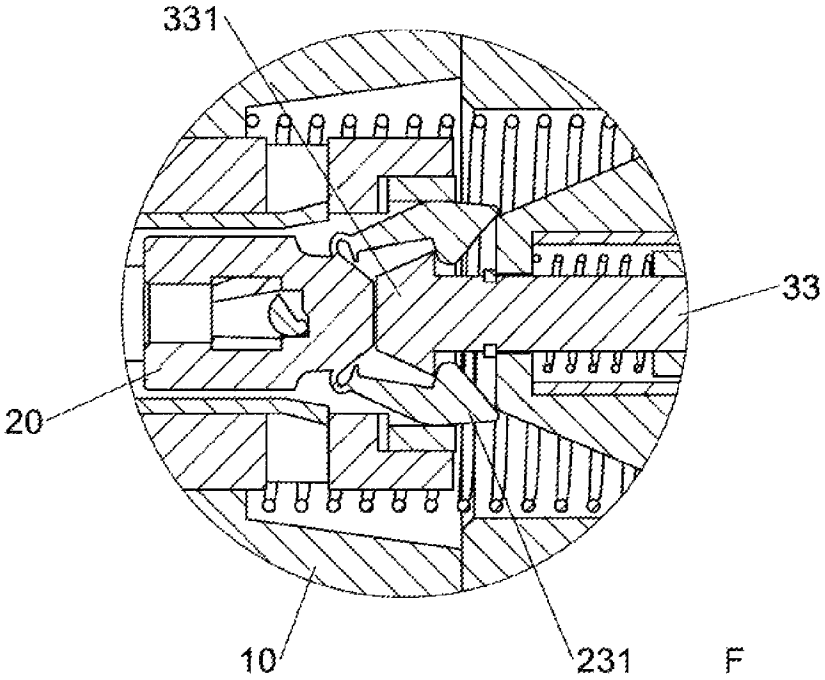
FIG. 19 is a locally enlarged view of the screwdriver structure taken along circle F as shown in FIG. 18.
Figure 20:
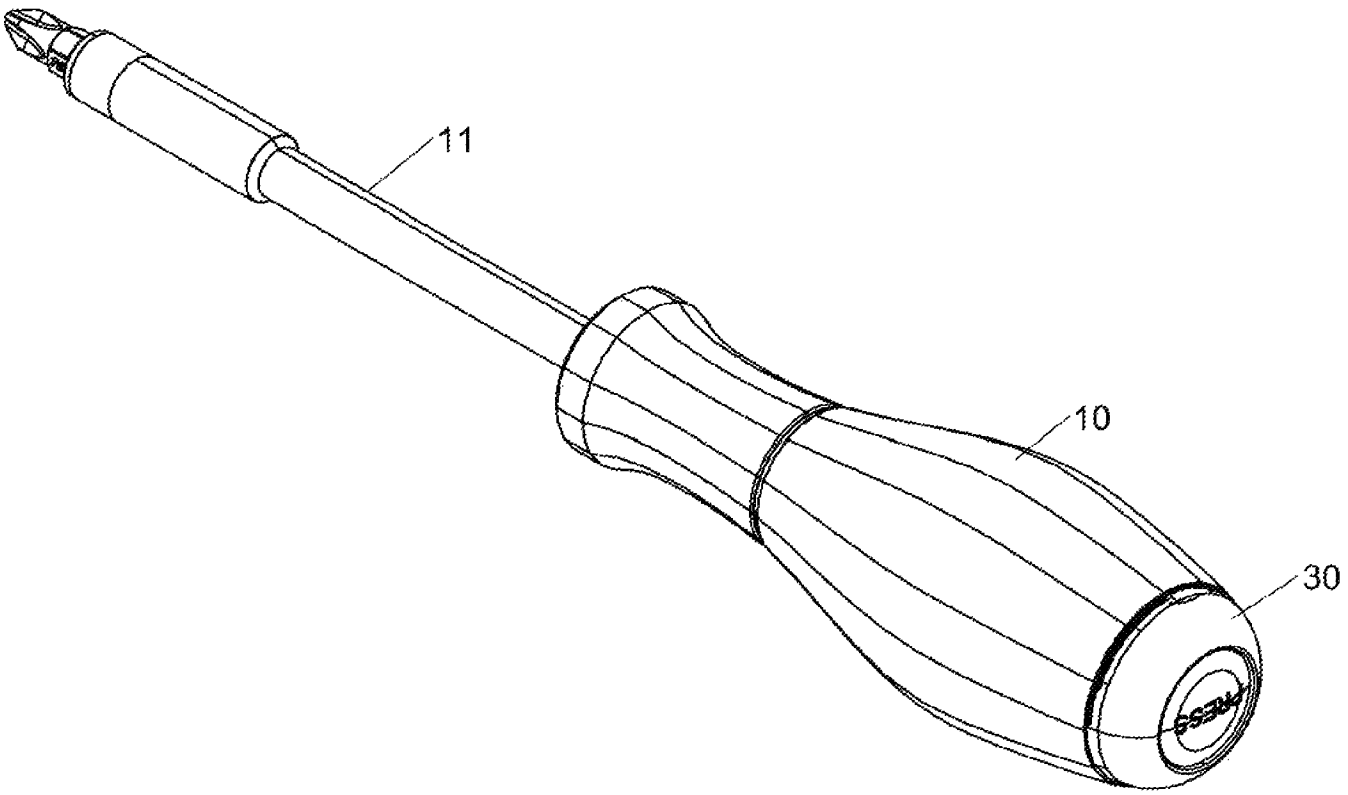
FIG. 20 is another perspective view of the screwdriver structure in accordance with the preferred embodiment of the present invention.

Referring to FIGS. 18-20 with reference to FIGS. 1-17, when the cover 38 is pushed, the press set 30 is moved and locked by the switch set 20 so that the press set 30 is secured to the main body 10, and the tip set 37 of the press set 30 is hidden in the first chamber 12 of the main body 10.

In another preferred embodiment of the present invention, the first seat 21 and the second seat 22 are formed integrally, and the tube 31 and the third seat 32 are formed integrally.

In another preferred embodiment of the present invention, the tube 31 and the cover 38 are formed integrally, and the rod 35 and the push member 39 are formed integrally.

The screwdriver structure of the present invention has the following advantages.

1. The press set 30 is assembled with the main body 10 and the switch set 20 and is movable in the first chamber 12. When the press set 30 is pressed, the press set 30 is moved to push the switch set 20 so that the press set 30 is locked by the two first clamping portions 231 and positioned in the first chamber 12 without detachment. When the press set 30 is pressed again, the press set 30 is unlocked from the two first clamping portions 231 so that the press set 30 is moved and exposed from the main body 10. Thus, the user only needs to press the press set 30 reciprocatingly to fold the press set 30 onto the main body 10 or expose the press set 30 from the main body 10, thereby facilitating the user operating the screwdriver structure.

2. The press set 30 is folded and hidden in the main body 10 when the switch set 20 is disposed at the locked state. When the press set 30 is pressed, the switch set 20 is disposed at the unlocked state so that the press set 30 is unlocked from the switch set 20. Then, the press set 30 is pushed by the third elastic member 40, and the at least one second slide 325 slides on the at least one first slide 15, such that the press set 30 is exposed from the first chamber 12 to facilitate the user taking the tip set 37. Thus, the user only needs to press the press set 30 to expose the press set 30 from the main body 10, thereby facilitating the user operating the press set 30.

3. The press set 30 is clamped by the two first clamping portions 231, and the elastic force the third elastic member 40 is applied on the two first clamping portions 231, so that the two first clamping portions 231 share the elastic force the third elastic member 40 evenly.

4. When press set 30 is pressed, the rod 35 and the pin 33 are driven by the push member 39 and moved toward the switch set 20, the second elastic member 36 is compressed by the rod 35, the pin 33 pushes the clamping block 23 which moves the control member 24 and presses the first elastic member 25, and the second shaft 241 is rotated in the third receiving recess 233, such that the moving portion 243 is unlocked from the locking portion 2224, the clamping block 23 is pushed by the first elastic member 25, and the two first clamping portions 231 are detached from the two first abutting portions 223, such that the two first clamping portions 231 are spaced from each other and fully exposed from the second receiving recess 221. Thus, the switch set 20 is disposed at the unlocked state, the second clamping portion 331 is released from the two first clamping portions 231, and the press set 30 is unlocked from the switch set 20, such that the press set 30 is pushed by the third elastic member 40, the at least one second slide 325 slides on the at least one first slide 15, and the press set 30 is exposed from the first chamber 12.

5. When the cover 38 is pushed, the press set 30 is driven by the cover 38 and moved toward the switch set 20, the third seat 32 compresses the third elastic member 40, the pin 33 pushes the clamping block 23, and the two first clamping portions 231 are pressed by the two first abutting portions 223, such that the two first clamping portions 231 are moved toward each other and hidden in the second receiving recess 221. At this time, the clamping block 23 moves the control member 24 and presses the first elastic member 25, the second shaft 241 is rotated in the third receiving recess 233, the moving portion 243 is moved to and locked on the locking portion 2224, such that the switch set 20 is disposed at the locked state, and the second clamping portion 331 is clamped by the two first clamping portions 231. Thus, the press set 30 is locked by the switch set 20 and hidden in the main body 10, and the cover 38 covers the first chamber 12.

6. When the clamping block 23 is pressed, the control member 24 is driven and moved by the clamping block 23, the second shaft 241 is naturally rotated in the third receiving recess 233, and the moving portion 243 is serially moved along the first path 2221, the second path 2222, and the third path 2223 to the locking portion 2224, and is locked on the locking portion 2224, such that the switch set 20 is disposed at the locked state. When the moving portion 243 is unlocked from the locking portion 2224, the moving portion 243 is serially moved along the fourth path 2225 and the fifth path 2226 to the first path 2221, such that the switch set 20 is disposed at the unlocked state.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the scope of the invention.

The invention claimed is:

1. A screwdriver structure comprising:

a main body;

a switch set assembled with the main body; and a press set assembled with the main body and the switch set;

wherein:

the main body has a first end provided with a drive portion and a second end provided with a handle;

the handle has an interior provided with a first chamber and a second chamber;

the first chamber has an opening;

the second chamber is connected to the first chamber and arranged between the drive portion and the first chamber;

a resting edge is formed between the first chamber and the second chamber;

the main body is provided with at least one first slide;

the at least one first slide is provided with a first limit portion;

the switch set is mounted in the first chamber and the second chamber;

the switch set includes a first seat secured in the second chamber, a second seat secured in a first receiving recess, a clamping block mounted in a second receiving recess, a control member assembled with the second seat and the clamping block, and a first elastic member biased between the second seat and the clamping block;

the first seat has an interior provided with the first receiving recess;

the second seat has an interior provided with the second receiving recess and has a side provided with a slideway connected to the second receiving recess;

the slideway includes a first path, a second path, a third path, a locking portion, a fourth path, and a fifth path;

the first path, the second path, the third path, the locking portion, the fourth path, and the fifth path construct a loop;

the second seat is provided with two first abutting portions;

the second receiving recess has a bottom provided with a first shaft;

the clamping block has a first end provided with two first clamping portions and a second end provided with a first receiving slot;

the clamping block is movable in the second receiving recess between a first location where the two first clamping portions are pressed by the two first abutting portions and approach each other, and a second location where the two first clamping portions are released from the two first abutting portions, are spaced from each other, and are exposed from the second receiving recess;

the clamping block is provided with a third receiving recess;

the third receiving recess is connected to the first receiving slot and arranged between the two first clamping portions and the first receiving slot;

the third receiving recess is provided with a second abutting portion;

when the switch set is pressed, the two first clamping portions are moved toward each other or moved away from each other;

the control member is provided with a second shaft extending through the third receiving recess;

the second shaft is provided with a third abutting portion that is movable to rest on the second abutting portion;

the control member is provided with a moving portion received in the slideway;

when the clamping block is pressed and moved in the second receiving recess, the moving portion is moved in the slideway, so that the second shaft is driven by the clamping block and rotated in the third receiving recess;

the clamping block is movable relative to the second seat between a first position where the moving portion is located at the first path and a second position where the moving portion is locked on the locking portion;

when the second shaft is driven by the clamping block and rotated in the third receiving recess, the moving portion is moved in the slideway, unlocked from the locking portion, and located at the first path, such that the clamping block is situated at the first position where the third abutting portion rests on the second abutting portion;

when the second shaft is further driven by the clamping block and rotated in the third receiving recess, the moving portion is moved in the slideway and locked in the locking portion, such that the clamping block is situated at the second position where the third abutting portion is detached from the second abutting portion;

when the clamping block is pressed repeatedly, the clamping block is movable between the first position and the second position reciprocatingly;

the two first clamping portions are away from each other when the clamping block is at the first position and are moved toward each other when the clamping block is at the second position;

the first elastic member is disposed between the second receiving recess and the first receiving slot;

the first elastic member is mounted on the first shaft and biased between a bottom of the second receiving recess and the second shaft;

the third abutting portion rests on the second abutting portion by an elastic force of the first elastic member, such that the moving portion is located at the first path, and the clamping block is situated at the first position relative to the second seat;

when the clamping block is moved in the second receiving recess, the two first clamping portions are pressed by the two first abutting portions such that the two first clamping portions are moved toward each other and retracted in the second receiving recess;

when the control member is moved by the clamping block, the second shaft is rotated in the third receiving recess, and the third abutting portion is detached from the second abutting portion, so that the moving portion is serially moved along the first path and the second path, and the first elastic member is compressed by the control member and the clamping block;

when the moving portion is further moved along the third path to the locking portion, the moving portion is locked on the locking portion, the switch set is disposed at a locked state, the first elastic member is slightly returned, and the control member and the clamping block are pushed slightly by the first elastic member and moved toward an opening of the second receiving recess, such that the two first clamping portions are moved to partially protrude from the second receiving recess and are moved toward each other, and the clamping block is situated at the second position;

when the clamping block is pressed again, the moving portion is unlocked from the locking portion, and the clamping block is pushed by the first elastic member, such that the moving portion is serially moved along the fourth path and the fifth path to the first path, and the clamping block is returned to the first position;

the press set is moved in the first chamber to push the switch set, so that the two first clamping portions are moved to clamp the press set;

when the press set is pressed again, the two first clamping portions are moved to release the press set;

the press set includes a tube, a third seat, a pin, a snap ring, a rod, a second elastic member, a tip set, a cover, and a push member;

the tube is provided with a passage;

the third seat is movably mounted in the first chamber;

the third seat is fitted with the tube so that the tube and the third seat are moved simultaneously;

the third seat has a first end provided with a coupling portion fitted on the tube;

the coupling portion has a bottom provided with a first resting face abutting the tube;

the third seat has a second end provided with a second resting face and a second receiving slot;

the second receiving slot has an opening facing the second chamber;

the third seat has an exterior provided with at least one second slide slidably connected with the at least one first slide so that the third seat is slidable linearly in the first chamber;

the at least one second slide is provided with a second limit portion that is movable to abut the first limit portion;

the pin passes the passage and the coupling portion;

the pin has a first end provided with a second clamping portion protruding from the third seat;

the second clamping portion presses the clamping block and engages the two first clamping portions;

when the clamping block is situated at the second position, the second clamping portion is clamped with the two first clamping portions so that the switch set is disposed at the locked state;

the pin is provided with a retaining groove;

the snap ring is retained in the retaining groove;

the rod is movably mounted in the passage;

the rod has a recessed first end fitted with a second end of the pin and a second end protruding from the tube;

the rod moves the pin when the rod is moved relative to the tube;

the second elastic member is received in the passage and mounted on the pin;

the second elastic member is biased between the first resting face and the first end of the rod;

the tip set is mounted on and moved with the tube synchronously;

the cover is fitted with the tube and covers the opening of the first chamber;

the cover is provided with a receiving space allowing passage of the rod;

the push member is fitted on the second end of the rod and movable in the receiving space;

when the push member is pushed, the rod and the pin are driven by the push member and moved in the passage;

when the third seat is moved in the first chamber, the at least one second slide slides relative to the at least one first slide, such that the tube, the pin, the snap ring, the rod, the second elastic member, the tip set, the cover, and the push member are moved synchronously; and the screwdriver structure further comprises a third elastic member housed in the first chamber and biased between the resting edge and the press set.

2. The screwdriver structure as claimed in claim 1, wherein the drive portion has a recessed end, the main body has multiple first slides, and the third seat has multiple second slides.

3. The screwdriver structure as claimed in claim 1, wherein the at least one first slide is mounted on or integrally formed on the main body.

4. The screwdriver structure as claimed in claim 1, wherein the first seat has a circular hollow shape, the first receiving recess has a rectangular shape, the second receiving recess has a rectangular shape, the locking portion has an arcuate concave shape, the first shaft has a cylindrical shape, and the moving portion is a circular stub.

5. The screwdriver structure as claimed in claim 1, wherein the passage has a circular shape, the coupling portion is a circular recess, the second receiving slot has a circular shape, the retaining groove has an annular shape and aligns with the second resting face, the snap ring rests on the second resting face, the rod has a circular shape, the tip set includes multiple screwdriver tips of different specifications, and the screwdriver tips are interchangeably mounted on the drive portion.

6. The screwdriver structure as claimed in claim 1, wherein the third elastic member is a spring that is elastically biased between the resting edge and the second receiving slot.

7. The screwdriver structure as claimed in claim 1, wherein:

when the cover is pushed, the cover, the tube, and the third seat are moved synchronously, and the at least one second slide slides on the at least one first slide, such that the cover moves the press set;

when the press set is moved in the first chamber toward the switch set, the third seat compresses the third elastic member, the pin pushes the clamping block, and the two first clamping portions are pressed by the two first abutting portions such that the two first clamping portions are moved toward each other and retracted in the second receiving recess;

the clamping block moves the control member and presses the first elastic member, the second shaft is rotated in the third receiving recess, the moving portion is serially moved along the first path, the second path, and the third path to the locking portion, and is locked on the locking portion, such that the switch set is disposed at the locked state, and the clamping block is situated at the second position;

after the moving portion is locked on the locking portion, the first elastic member is slightly returned, the control member and the clamping block are pushed slightly by the first elastic member and moved toward the opening of the second receiving recess, such that the two first clamping portions are moved to partially protrude from the second receiving recess, and the second clamping portion is clamped by the two first clamping portions; and the second clamping portion is restricted by the two first clamping portions such that the press set is locked by the switch set and retracted in the main body, and the cover covers the first chamber.

8. The screwdriver structure as claimed in claim 1, wherein:

when the push member is pressed, the rod and the pin are driven by the push member and moved toward the switch set, the second elastic member is compressed by the rod, the pin pushes the clamping block which moves the control member and presses the first elastic member, the second shaft is rotated in the third receiving recess, such that the moving portion is unlocked from the locking portion, and the clamping block is pushed by the first elastic member, such that the moving portion is serially moved along the fourth path and the fifth path to the first path;

the first elastic member is elastically returned and moves the control member and the clamping block, and the two first clamping portions are detached from the two first abutting portions such that the two first clamping portions are spaced from each other and fully exposed from the second receiving recess, the switch set is disposed at an unlocked state, and the clamping block is situated at the first position; and the second clamping portion is released from the two first clamping portions, and the press set is unlocked from the switch set, such that the press set is pushed by the third elastic member, and the at least one second slide slides on the at least one first slide, such that the press set is exposed from the first chamber.

9. The screwdriver structure as claimed in claim 1, wherein the first seat and the second seat are formed integrally, and the tube and the third seat are formed integrally.

10. The screwdriver structure as claimed in claim 1, wherein the tube and the cover are formed integrally, and the rod and the push member are formed integrally.

* * * * *